US012529293B2

(12) United States Patent
Lowe et al.

(10) Patent No.: US 12,529,293 B2
(45) Date of Patent: Jan. 20, 2026

(54) ORIENTED-PERFORATION TOOL

(71) Applicant: Schlumberger Technology Corporation, Sugar Land, TX (US)

(72) Inventors: Erick Lowe, Clamart (FR); Andrew Prisbell, Sugar Land, TX (US); Steven Hernandez, Rosharon, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 18/893,243

(22) Filed: Sep. 23, 2024

(65) Prior Publication Data

US 2025/0084738 A1 Mar. 13, 2025

Related U.S. Application Data

(63) Continuation of application No. 18/252,593, filed as application No. PCT/US2021/059400 on Nov. 15, 2021, now Pat. No. 12,098,623.

(60) Provisional application No. 63/198,792, filed on Nov. 13, 2020.

(51) Int. Cl.

| | |
|---|---|
| ***E21B 43/117*** | (2006.01) |
| ***E21B 43/116*** | (2006.01) |
| ***E21B 43/119*** | (2006.01) |

(52) U.S. Cl.

CPC ..... *E21B 43/117* (2013.01); *E21B 43/116* (2013.01); *E21B 43/119* (2013.01)

(58) Field of Classification Search

CPC ..... E21B 43/116; E21B 43/11; E21B 43/117; E21B 43/119; F42B 1/02

See application file for complete search history.

(56) References Cited

U.S. PATENT DOCUMENTS

| | | | |
|---|---|---|---|
| 2,062,974 | A | 12/1936 | Lane |
| D126,856 | S | 4/1941 | Ricou |
| 2,252,270 | A | 8/1941 | Miller |
| 2,980,017 | A | 4/1961 | Castel |
| 3,067,679 | A | 12/1962 | Caldwell |
| 3,173,992 | A | 3/1965 | Boop |
| 3,612,189 | A | 10/1971 | Brooks |
| 3,836,843 | A | 9/1974 | Yonce |

(Continued)

FOREIGN PATENT DOCUMENTS

| | | | |
|---|---|---|---|
| CA | 2532088 | C | 7/2009 |
| CA | 3044516 | A1 | 7/2018 |

(Continued)

OTHER PUBLICATIONS

Advisory Action issued in U.S. Appl. No. 14/888,882 dated Sep. 21, 2021, 6 pages.

(Continued)

*Primary Examiner* — Yong-Suk (Philip) Ro

(74) *Attorney, Agent, or Firm* — Jeffrey D. Frantz

(57) ABSTRACT

Shaped charge tools are provided for perforating hydrocarbon wells. A shaped charge frame assembly may include a tubular electrical conductor and a shaped charge frame disposed around the tubular electrical conductor and rotatably engaged with the tubular electrical conductor. One or more bearings may be used to engage the shaped charge frame with the tubular electrical conductor, or the engagement may be bearing-free.

16 Claims, 9 Drawing Sheets

(56) References Cited

U.S. PATENT DOCUMENTS

| | | | |
|---|---|---|---|
| 3,965,993 | A | 6/1976 | Lavigne |
| 3,991,836 | A | 11/1976 | Bouguyon |
| 4,004,643 | A | 1/1977 | Newman |
| 4,191,265 | A | 3/1980 | Bosse-Platiere |
| 4,296,481 | A | 10/1981 | Weiss |
| D265,335 | S | 7/1982 | Kirkpatrick |
| 4,519,313 | A | 5/1985 | Leidel |
| 4,523,649 | A | 6/1985 | Stout |
| 4,619,333 | A | 10/1986 | George |
| 4,759,291 | A | 7/1988 | Barker |
| 4,850,438 | A | 7/1989 | Regalbuto |
| 4,909,320 | A | 3/1990 | Hebert |
| 5,007,486 | A | 4/1991 | Ricles |
| 5,237,136 | A | 8/1993 | Langston |
| 5,351,622 | A | 10/1994 | Ekholm |
| 5,756,926 | A | 5/1998 | Bonbrake |
| 5,785,130 | A | 7/1998 | Wesson |
| 5,816,343 | A | 10/1998 | Markel |
| 6,082,265 | A | 7/2000 | Sakamoto |
| 6,311,621 | B1 | 11/2001 | Marshall |
| 6,412,338 | B2 | 7/2002 | Boyle |
| 6,412,388 | B1 | 7/2002 | Frazier |
| 6,412,415 | B1 | 7/2002 | Kothari |
| 6,595,290 | B2 | 7/2003 | George |
| 6,655,289 | B1 | 12/2003 | Bornheim |
| 6,752,083 | B1 | 6/2004 | Lerche |
| 7,013,977 | B2 | 3/2006 | Nordaas |
| 7,347,278 | B2 | 3/2008 | Lerche |
| 7,762,331 | B2 | 7/2010 | Goodman |
| D633,166 | S | 2/2011 | Richardson |
| D642,235 | S | 7/2011 | Harasts |
| 8,002,035 | B2 | 8/2011 | Hales |
| 8,056,632 | B2 | 11/2011 | Goodman |
| 8,066,083 | B2 | 11/2011 | Hales |
| 8,113,119 | B2 | 2/2012 | Crawford |
| 8,127,848 | B2 | 3/2012 | Myers, Jr. |
| 8,256,337 | B2 | 9/2012 | Hill |
| 8,408,132 | B2 | 4/2013 | Lucas |
| 8,443,886 | B2 | 5/2013 | Torres |
| 8,596,378 | B2 | 12/2013 | Mason |
| 8,943,943 | B2 | 2/2015 | Tassaroli |
| D723,647 | S | 3/2015 | Oliver |
| 9,115,572 | B1 | 8/2015 | Hardesty |
| 9,145,764 | B2 | 9/2015 | Burton |
| 9,382,784 | B1 | 7/2016 | Hardesty |
| 9,494,021 | B2 | 11/2016 | Parks |
| 9,581,422 | B2 | 2/2017 | Preiss |
| 9,605,937 | B2 | 3/2017 | Eitschberger |
| 9,702,680 | B2 | 7/2017 | Parks |
| 9,903,185 | B2 | 2/2018 | Ursi |
| 10,188,990 | B2 * | 1/2019 | Burmeister ..... B01D 61/20 |
| 10,190,398 | B2 | 1/2019 | Goodman |
| 10,273,788 | B2 | 4/2019 | Bradley |
| 10,338,030 | B2 | 7/2019 | Bittar |
| 10,429,161 | B2 | 10/2019 | Parks |
| 10,458,213 | B1 | 10/2019 | Eitschberger |
| 10,472,938 | B2 | 11/2019 | Parks |
| D881,322 | S | 4/2020 | Cugini |
| 10,677,026 | B2 | 6/2020 | Sokolove |
| 10,900,334 | B2 | 1/2021 | Knight |
| 11,078,762 | B2 | 8/2021 | Mauldin |
| 11,293,737 | B2 | 4/2022 | Sullivan |
| 11,641,371 | B2 | 5/2023 | Al Jarri |
| 11,988,079 | B2 | 5/2024 | Prisbell |
| 12,385,369 | B2 * | 8/2025 | Eitschberger ..... E21B 43/119 |
| 2004/0216632 | A1 | 11/2004 | Finsterwald |
| 2004/0216866 | A1 | 11/2004 | Barlow |
| 2005/0211467 | A1 | 9/2005 | Ratanasirigulchia |
| 2008/0149338 | A1 | 6/2008 | Goodman |
| 2009/0151589 | A1 | 6/2009 | Henderson |
| 2009/0159285 | A1 | 6/2009 | Goodman |
| 2010/0005992 | A1 | 1/2010 | Crawford |
| 2010/0011945 | A1 | 1/2010 | Loehr |
| 2010/0024674 | A1 | 2/2010 | Peeters |
| 2010/0230163 | A1 | 9/2010 | Hales |
| 2010/0300750 | A1 | 12/2010 | Hales |
| 2011/0024116 | A1 | 2/2011 | McCann |
| 2012/0018157 | A1 | 1/2012 | Gill |
| 2012/0138286 | A1 | 6/2012 | Mason |
| 2012/0152542 | A1 | 6/2012 | Le |
| 2012/0180678 | A1 | 7/2012 | Kneisl |
| 2012/0199352 | A1 | 8/2012 | Lanclos |
| 2012/0247769 | A1 | 10/2012 | Schacherer |
| 2012/0247771 | A1 | 10/2012 | Black |
| 2013/0043074 | A1 | 2/2013 | Tassaroli |
| 2013/0048376 | A1 | 2/2013 | Rodgers |
| 2013/0153205 | A1 | 6/2013 | Borgfeld |
| 2014/0312752 | A1 | 10/2014 | Durisotti |
| 2014/0338552 | A1 | 11/2014 | Mace |
| 2015/0330192 | A1 | 11/2015 | Rogman |
| 2016/0168961 | A1 | 6/2016 | Parks |
| 2016/0356132 | A1 | 12/2016 | Burmeister |
| 2017/0176152 | A1 | 6/2017 | Goodman |
| 2017/0211363 | A1 | 7/2017 | Bradley |
| 2017/0275976 | A1 | 9/2017 | Collins |
| 2018/0299239 | A1 | 10/2018 | Eitschberger |
| 2018/0306010 | A1 | 10/2018 | Von Kaenel |
| 2019/0040722 | A1 | 2/2019 | Yang |
| 2019/0186241 | A1 | 6/2019 | Yang |
| 2019/0195054 | A1 | 6/2019 | Bradley |
| 2019/0257181 | A1 | 8/2019 | Langford |
| 2019/0292887 | A1 | 9/2019 | Austin |
| 2019/0353013 | A1 | 11/2019 | Sokolove |
| 2020/0018139 | A1 | 1/2020 | Eitschberger |
| 2020/0024934 | A1 | 1/2020 | Eitschberger |
| 2020/0024935 | A1 | 1/2020 | Eitschberger |
| 2020/0048996 | A1 | 2/2020 | Anthony |
| 2020/0072029 | A1 | 3/2020 | Anthony |
| 2020/0200516 | A1 | 6/2020 | Zemla |
| 2020/0217635 | A1 * | 7/2020 | Eitschberger ..... F42D 1/04 |
| 2020/0256167 | A1 | 8/2020 | Gupta |
| 2020/0284126 | A1 * | 9/2020 | Mauldin ..... E21B 43/117 |
| 2020/0308939 | A1 | 10/2020 | Sullivan |
| 2021/0055092 | A1 | 2/2021 | Sullivan |
| 2021/0156231 | A1 | 5/2021 | Sullivan |
| 2021/0247771 | A1 | 8/2021 | Watanabe |
| 2021/0396103 | A1 | 12/2021 | Macgillivray |
| 2022/0056789 | A1 * | 2/2022 | Lagrange ..... E21B 43/1185 |
| 2022/0074719 | A1 | 3/2022 | Yang |
| 2022/0154559 | A1 | 5/2022 | Sadler |
| 2022/0213767 | A1 * | 7/2022 | Prisbell ..... E21B 43/117 |
| 2022/0290960 | A1 | 9/2022 | Prisbell |
| 2022/0333906 | A1 | 10/2022 | Lowe |
| 2023/0131652 | A1 | 4/2023 | Loehken |
| 2023/0323759 | A1 | 10/2023 | Eitschberger |
| 2024/0287879 | A1 | 8/2024 | Roberts |
| 2024/0301774 | A1 | 9/2024 | Prisbell |

FOREIGN PATENT DOCUMENTS

| | | | |
|---|---|---|---|
| CN | 2244095 | Y | 1/1997 |
| CN | 2823548 | Y | 10/2006 |
| CN | 101498209 | A | 8/2009 |
| CN | 101575965 | A | 11/2009 |
| CN | 102031952 | A | 4/2011 |
| CN | 202417452 | U | 9/2012 |
| CN | 108351192 | A | 7/2018 |
| EP | 132330 | A2 | 1/1985 |
| EP | 0175439 | A2 | 3/1986 |
| EP | 0601880 | A2 | 6/1994 |
| EP | 0919694 | A2 | 6/1999 |
| EP | 1930541 | A2 | 6/2008 |
| EP | 2268893 | B1 | 11/2018 |
| RU | 73390 | U1 | 5/2008 |
| RU | 78521 | U1 | 11/2008 |
| RU | 121054 | U1 | 10/2012 |
| RU | 2561828 | C2 | 9/2015 |
| SU | 258201 | A1 | 12/1969 |
| WO | 2001096807 | A2 | 12/2001 |
| WO | 2011080291 | A2 | 7/2011 |
| WO | 2012135101 | A2 | 10/2012 |
| WO | 2013180765 | A1 | 12/2013 |
| WO | 2014089194 | A1 | 6/2014 |
| WO | 2014179669 | A1 | 11/2014 |

(56) References Cited

FOREIGN PATENT DOCUMENTS

| | | | |
|---|---|---|---|
| WO | 2018026952 | A1 | 2/2018 |
| WO | 2018213782 | A1 | 11/2018 |
| WO | 2020232242 | A1 | 11/2020 |
| WO | 2021122797 | A1 | 6/2021 |

OTHER PUBLICATIONS

Communication article 94-3 issued in the related EP application 13860417.8, dated Jan. 19, 2018 (5 pages).
Communication article 94-3 issued in the related EP application 13860417.8, dated Mar. 8, 2017 (6 pages).
Communication article 94-3 issued in the related EP application 13860417.8, dated Mar. 9, 2016 (6 pages).
Decision of Grant issued in the related RU application 2015126872, dated Dec. 1, 2016 (12 pages).
English translation of Exam Report issued in the related AR Patent Application No. 20140101829, dated Aug. 30, 2021, 2 pages.
European Search Report issued in the related EP application 13860417.8, dated Feb. 22, 2016 (6 pages).
Exam Report issued in the related AR Patent Application No. 20140101829 dated Apr. 16, 2020, 5 pages.
Exam Report issued in the related CA Application 2892378 dated Nov. 15, 2019, 4 pages.
H-2 Perforating System, Titan division, 2019 (1 page).
International Preliminary Report on Patentability issued in the PCT Application PCT/US2020/017262 dated Aug. 19, 2021, 11 pages.
International Preliminary Report on Patentability issued in the PCT Application PCT/US2020/032879 dated Nov. 25, 2021, 8 pages.
International Preliminary Report on Patentability issued in the related PCT application PCT/US2013/073094, dated Jun. 9, 2015 (5 pages).
International Preliminary Report on Patentability issued in the related PCT application PCT/US2014/036541, dated Nov. 3, 2015 (09 pages).
International Search Report and Written Opinion issued in the PCT Application PCT/US2020/017262 dated Jun. 19, 2020, 13 pages.
International Search Report and Written Opinion issued in the PCT Application PCT/US2020/032879, dated Aug. 28, 2020 (10 pages).
International Search Report and Written Opinion issued in the related PCT application PCT/US2013/073094, dated Mar. 20, 2014 (9 pages).
International Search Report and Written Opinion issued in the related PCT application PCT/US2014/036541, dated Sep. 12, 2014 (13 pages).
Merriam-Webster Dictionary, multiple various definitions for the term "bulkhead", published in Jan. 2013. (Year: 2013).
Notice of Allowance issued in U.S. Appl. No. 16/021,061 dated Aug. 11, 2021, 8 pages.
Office action issued in the related CN application 201380062953.4, dated Feb. 27, 2018 (11 pages).
Office action issued in the related CN application 201380062953.4, dated Jun. 15, 2017 (20 pages).
Office action issued in the related CN application 201380062953.4, dated Sep. 1, 2016 (22 pages).
Office action issued in the related RU application 2015126872, dated Aug. 19, 2016 (8 pages).
Office Action issued in the related U.S. Appl. No. 14/888,882 dated Dec. 3, 2021, 16 pages.
Office Action issued in the related U.S. Appl. No. 14/888,882 dated Apr. 13, 2021, 16 pages.
Office Action issued in the related U.S. Appl. No. 14/888,882 dated Jan. 30, 2020, 26 pages.
Office Action issued in the related U.S. Appl. No. 14/888,882 dated May 25, 2018 (36 pages).
Office Action issued in the related U.S. Appl. No. 14/888,882 dated Nov. 2, 2018 (24 pages).
Office Action issued in the related U.S. Appl. No. 14/888,882 dated Nov. 24, 2017 (28 pages).
Office Action issued in the related U.S. Appl. No. 16/021,061 dated Apr. 20, 2020, 20 pages.
Office Action issued in the related U.S. Appl. No. 16/021,061 dated Sep. 9, 2020, 11 pages.
Titan H2 Perforating Gun System, (2019) 2 pages, Link: https://www.oilfieldtechnology.com/product-news/07022019/hunting-introduces-h-2-perforating-system/.
Office Action issued in U.S. Appl. No. 17/235,616, filed Mar. 16, 2022, 8 pages.
Notice of Allowance issued in U.S. Appl. No. 14/888,882 dated Jun. 20, 2022, 8 pages.
Extended Search issued in European Patent Application No. 20752538.7 dated Sep. 30, 2022, 8 pages.
International Search Report and Written Opinion issued in the PCT Application No. PCT/US/2021/059401 on Feb. 24, 2022, 11 pages.
International Preliminary Report on Patentability issued in the PCT Application PCT/US2021/059401 dated May 25, 2023, 8 pages.
Hunting introduces H-2 Perforating System, downloaded from https://www.oilfieldtechnology.com/product-news/07022019/hunting-introduces-h-2-perforating-system/, Oilfield Technology, Feb. 7, 2019, 2 pages.
Geodynamics, Hellfire perforating system, 2019, 2 pages.
International Search Report and Written Opinion issued in the PCT Application No. PCT/US2021/059400 dated Feb. 24, 2022, 8 pages.
International Preliminary Report on Patentability issued in the PCT Application No. PCT/US2021/059400 dated May 25, 2023, 7 pages.
Office Action issued in U.S. Appl. No. 17/595,411 dated Jul. 28, 2023, 21 pages.
Notice of Allowance issued in Chinese Patent Appl. No. 202080021773.1 on Sep. 5, 2023; 8 pages.
Office Action and Search Report issued in Russian Patent Appl. No. 2021136889 on Sep. 4, 2023; 14 pages (with English translation).
Notice of Allowance issued in Design U.S. Appl. No. 29/750,153, filed Oct. 17, 2023; 9 pages.
"Shaped Charges, engineered for your rock" [online]. JRC designs. [Retrieved on Oct. 2, 2023]. V Retrieved from the Internet: <https://www.jetresearch.com/en/energetics/shaped-charges>.
First Office Action issued in Chinese Patent Application No. 202080041837.4 dated Mar. 27, 2024, 21 pages.
Office Action issued in U.S. Appl. No. 18/252,575 dated Aug. 2, 2024, 74 pages.
Office Action issued in U.S. Appl. No. 18/252,575 dated Nov. 8, 2024, 20 pages.

* cited by examiner

ORIENTED-PERFORATION TOOL

CROSS-REFERENCE TO RELATED APPLICATIONS

The present application is a continuation of U.S. Non-Provisional Application No. 18/252,593, filed on May 11, 2023, now U.S. Pat. No. 12,098,623, which is a National Stage Entry of International Patent Application No. PCT/US2021/059400, filed on Nov. 15, 2021, and claims priority benefit of U.S. Provisional Application No. 63/198,792, filed Nov. 13, 2020, the entirety of which is incorporated by reference herein and should be considered part of this specification.

FIELD

Perforation tools and components used in hydrocarbon production are described herein. Specifically, new apparatus and methods for orienting charges in a perforation tool are described.

BACKGROUND

Perforation tools are tools used in oil and gas production to form holes, passages, and/or fractures in hydrocarbon-bearing geologic formations to promote flow of hydrocarbons from the formation into the well for production. The tools generally have explosive charges shaped to project a jet of reaction products, including hot gases and molten metal, into the formation. The tool has a generally tubular profile, and includes support frames, ignition circuits, and potentially wiring for activating the charges and communicating signals and/or data along the tool. The charges are generally shaped like a cone or a bell, and the charges are generally activated by delivering energy, such as thermochemical energy and/or electrical energy, to an apex region of the charge.

The shaped charges are installed in the perforation tool before lowering the tool into a well. Generally, perforation in a specific direction at a specific location is desired. Thus, the tool is typically oriented to point the blast vector from the shaped charges in the desired direction. Mispositioning of the perforation tool, even slightly, can result in a sub-optimal perforation. Thus, methods and apparatus for orienting perforation tools are needed.

SUMMARY

Embodiments described herein provide a shaped charge frame assembly, comprising a tubular electrical conductor and a shaped charge frame disposed around the tubular electrical conductor and rotatably engaged with the tubular electrical conductor.

Other embodiments described herein provide a perforation tool, comprising a shaped charge frame assembly, comprising a shaped charge frame having at least one shaped charge receptacle and a longitudinal axis that does not intersect the shaped charge receptacle; a frame electrical conductor disposed along the longitudinal axis of the shaped charge frame, wherein the shaped charge frame is rotatable about the frame electrical conductor; and a bulkhead assembly, comprising a bulkhead member having a longitudinal axis and a conduit along the longitudinal axis of the bulkhead member; and a bulkhead electrical conductor disposed in the conduit and coupled to the frame electrical conductor, wherein the shaped charge frame is spaced apart from the bulkhead member.

Other embodiments described herein provide a shaped charge frame assembly, comprising a shaped charge frame having at least one shaped charge receptacle and a longitudinal axis that does not intersect the shaped charge receptacle; an electrical conductor disposed through the shaped charge frame along the longitudinal axis of the shaped charge frame; and at least two cylindrical bearings disposed around the electrical conductor, wherein the at least two bearings are freely rotatable between the electrical conductor and the shaped charge frame.

DETAILED DESCRIPTION

The perforation tools described herein use shaped charges to project jets of hot material outward from a wellbore into a subterranean formation. The shaped charges are housed in a frame that orients the shaped charges to direct the jets of hot material in a desired direction. The shaped charge frames described herein are self-orienting within the perforation tool.

Figure 1:
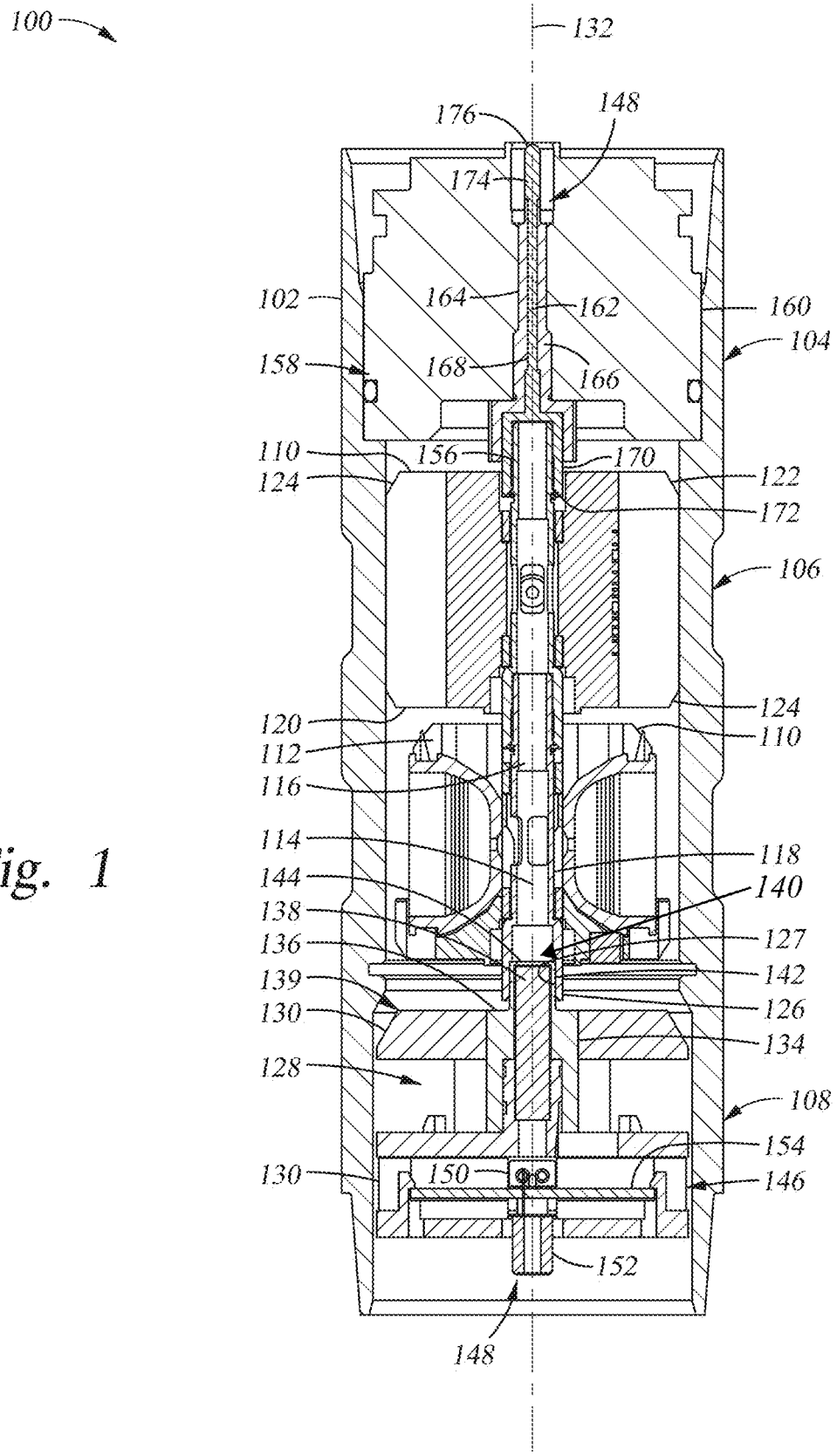
FIG. 1 is a cross-sectional view of a perforation tool according to one embodiment.

FIG. 1 is a cross-sectional view of a perforation tool 100 according to one embodiment. The perforation tool 100 has a housing 102 with a bulkhead section 104, a charge section 106, and an initiator section 108. The charge section 106 of the housing 102 has an inner radius that is less than an inner radius of either the bulkhead section 104 or the initiator section 108. Thus, when assembling the perforation tool 100, the charge section 106 is loaded first, and then the bulkhead section 104 and initiator section 108 are loaded afterward.

At least one shaped charge frame assembly 110 is disposed in the charge section 106 of the housing 102. In this case, two identical shaped charge frame assemblies 110 are shown to illustrate the modular construction of the shaped charge frame assemblies 110. The shaped charge frame assembly 110 has a shaped charge frame 112 with a longitudinal axis 114 and a central conduit 116 along the longitudinal axis 114. A frame electrical conductor 118 is disposed along the longitudinal axis 114 to provide electrical connectivity from a first end 120 of the shaped charge frame assembly 110 to a second end 122 of the shaped charge frame assembly 110 opposite from the first end 120. Each of the first end 120 and the second end 122 has a beveled edge 124 in the embodiments shown herein. The beveled edge 124 is optional. In this case, the beveled edge 124 can be helpful in assembling the shaped charge frames 110 into the housing 102. Each shaped charge frame 112 is freely rotatable within the housing 102 by operation of one or more bearings disposed between the shaped charge frame 112 and the frame electrical conductor 118, to be discussed further below.

The frame electrical conductor 118, in this case, is disposed through the conduit 116 and protrudes from both ends of the shaped charge frame 112 to provide electrical connectivity with other members of the perforation tool 100. At the first end 120, the frame electrical conductor 118 has a first connector 126 for connecting with an initiator assembly 128 housed in the initiator section 108 of the housing 102. The first connector 126 has an opening 127 for receiving an electrical connector of another member of the perforation tool.

The initiator assembly 128 has an initiator housing 130 with a longitudinal axis 132 that, when assembled in the perforation tool 100 is substantially coaxial with the longitudinal axis 114 of the shaped charge frame 112. The initiator housing 130 has a central conduit 134 in which an initiator electrical conductor 136 is disposed. The initiator housing 130 may be made of a material that is not electrically conductive. Alternately, the initiator housing 130 may be made of an electrically conductive material, and an insulator may be disposed in the central conduit 134 between an interior wall of the central conduit 134 and the initiator electrical conductor 136.

The initiator electrical conductor 136 is hollow for housing a detonator 138, shown here inserted into the initiator electrical conductor 136 for operation. A first end 142 of the initiator electrical conductor 136 protrudes from a first end 139 of the initiator housing 130, defining a first end 140 of the initiator assembly 128. The first end 142 of the initiator electrical conductor 136 has an opening 144 to provide fluid connectivity from the initiator assembly 128 to other portions of the perforation tool 100. Here, the first end 142 of the initiator electrical conductor 136 is inserted into the first connector 126 of the frame electrical conductor 118. The frame electrical conductor 118 is hollow, so the opening 144 of the initiator electrical conductor 136 provides fluid connectivity to the interior of the frame electrical conductor 118.

When assembled into the initiator electrical conductor 136, the detonator 138 is electrically connected to an initiator switch assembly 146 disposed in the initiator housing 130 at or near a second end 148 of the initiator assembly 128, opposite from the first end 140. The initiator switch assembly 146 has a switch connector 150 that is electrically connected to the detonator 138, which may be through the initiator electrical conductor 136 or may be through another electrical conductor. The initiator assembly 128 has an electrical connector 152 at the second end 148 of the initiator assembly 128, which protrudes beyond the initiator housing 130 and defines the second end 148. The electrical connector 152 is typically electrically coupled to the initiator switch assembly 146 to provide electrical continuity from the first end 140 of the initiator assembly 128 to the second end 148. Here, the electrical connector 152 is electrically coupled to the switch connector 150 through a switch circuit 154 positioned in a transverse orientation in the initiator housing 130 near the second end 148 of the initiator assembly 128.

At the second end 122 of the shaped charge frame assembly 110, the frame electrical conductor 118 has a second connector 156 for connecting with a bulkhead assembly 158. The bulkhead assembly 158 includes a bulkhead member 160 with a longitudinal axis 162 that, when assembled in the perforation tool 100 is substantially coaxial with the longitudinal axis 114 of the shaped charge frame 112 and the longitudinal axis 132 of the initiator housing 130. The bulkhead member 160 has a central conduit 164 disposed along the longitudinal axis 162. The bulkhead member 160 is typically made of a dense material, such as metal, to provide protection from the ballistic discharge of the shaped charges. When the bulkhead member 160 is made of an electrically conductive material, an insulator lining 166 is disposed in the central conduit 164 and a bulkhead electrical conductor 168 is routed through the insulator lining 166. The bulkhead electrical conductor 168 has a first connector 170 at a first end 172 of the bulkhead electrical conductor 168 for connecting with the second connector 156 of the frame electrical conductor 118. The bulkhead electrical conductor 168 has a second connector 174 at a second end 176 of the bulkhead electrical conductor 168 for electrical continuity across the bulkhead assembly 158.

The electrical conductors 118, 136, and 168, along with the connector 150 of the initiator assembly, provide electrical continuity along the perforation tool 100 from end to end. The hollow electrical conductors 136 and 118 also provide ballistic continuity along the central conduits of the initiator housing 130 and the shaped charge frames 112.

Figure 2A:
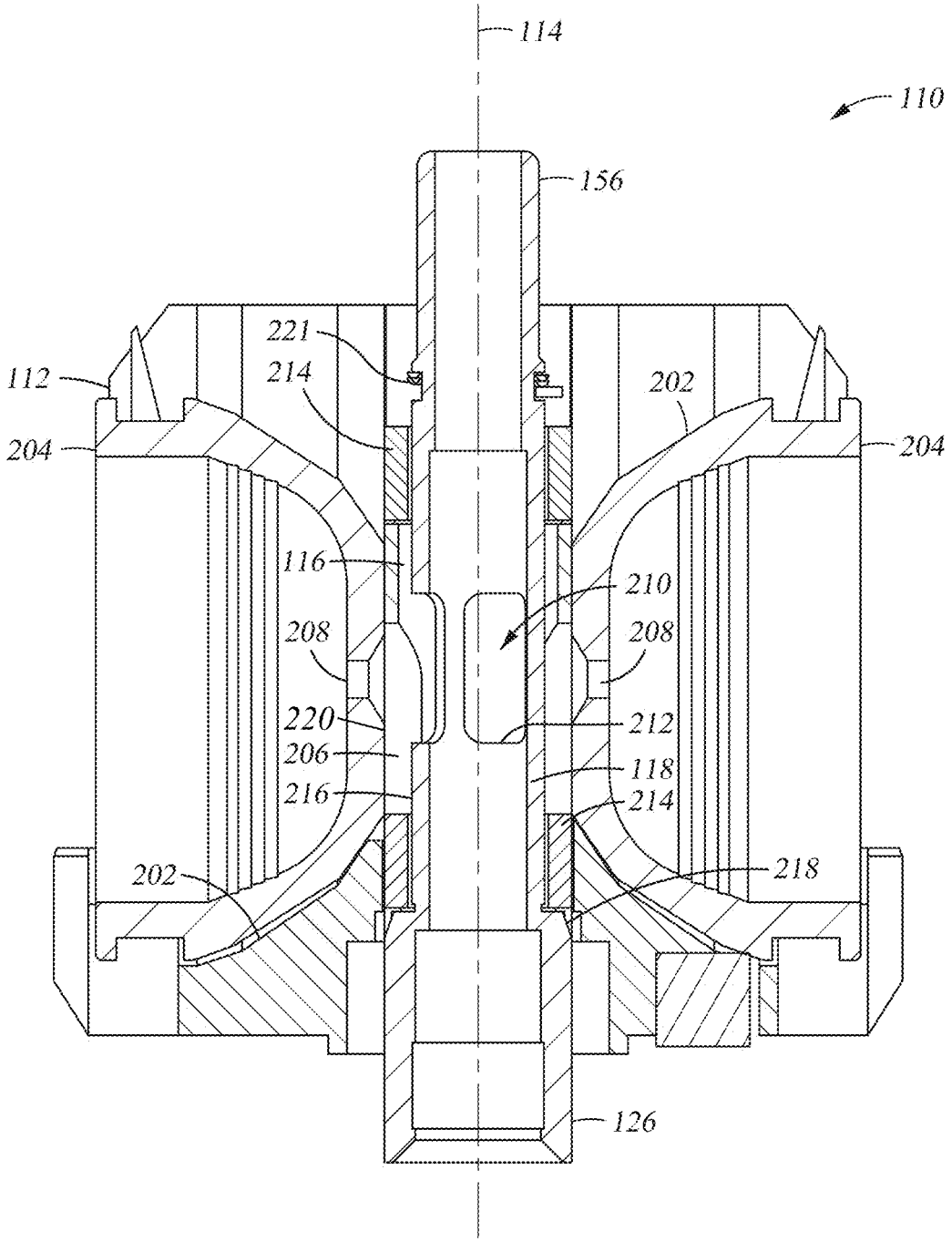
FIG. 2A is a cross-sectional view of the shaped charge frame assembly of FIG. 1.

FIG. 2A is a cross-sectional view of the shaped charge frame assembly 110. The shaped charge frame 112, in this case, has two shaped charge receptacles 202. A shaped charge 204 is shown inserted into each shaped charge receptacle 202. With only two shaped charge receptacles 202, the receptacles are located at an azimuthal displacement, one to the other, of 180°. In other cases, the shaped charge frame could have three shaped charge receptacles 202, each with azimuthal displacement from the other two of 120°.

Each shaped charge receptacle 202 has an opening 206 at the central conduit 116, the opening 206 providing a fluid pathway from the central conduit 116 to the shaped charge receptacle 202. The shaped charges 204 generally have openings 208 to expose explosive materials therein to the central conduit 116 through the openings 206 in the shaped charge receptacles 202. The frame electrical conductor 118 is hollow, with an interior 210 to accommodate ballast members (not shown), which function to receive a ballistic transmission into the interior 210 from an adjacent member of the perforation tool 100 (FIG. 1) and transmit ballistic energy along the interior 210 to another adjacent member of the perforation tool 100. The frame electrical conductor 118 has a plurality of lateral openings 212 formed through an outer wall thereof to provide a fluid pathway from the interior 210 of the frame electrical conductor 118 through the openings 206 to the interior of the shaped charge receptacles 202. Where a shaped charge 204 occupies one of the shaped charge receptacles 202, the ballistic energy translates through the opening 208 of the shaped charge to activate the explosive material therein.

The frame electrical conductor 118 does not contact the shaped charge frame 112. At least one bearing 214 is disposed around the frame electrical conductor 118 to provide rotational motion of the shaped charge frame 112 with respect to the frame electrical conductor 118. Here, there are two bearings 214 disposed on either side of the openings 212, but a single bearing could be used spanning across the openings 212 if the bearing also has openings to allow ballistic transfer into the shaped charge receptacles 202.

More than two bearings could also be used, for example if instead of one of the bearings 214 two or more bearings are used.

The bearings 214 are cylindrical bands that are disposed between the frame electrical conductor 118 and the shaped charge frame 112. A space is provided between each bearing 214 and both the frame electrical conductor 118 and the central conduit 116 of the shaped charge frame 112 such that each bearing has complete rotational freedom of movement between the frame electrical conductor 118 and the shaped charge frame 112. As a result, each shaped charge frame 112 has complete rotational freedom of movement within the housing 102 (FIG. 1) of the perforation tool 100.

The first connector 126 of the frame electrical conductor 118 has an outer radius that is greater than an outer radius of a central portion 216 of the frame electrical conductor 118. The frame electrical conductor 118 has a shoulder 218 between the first connector 126 and the central portion 216 that functions to restrain one of the bearings 214 in an axial direction. A bridge portion 220 of the shaped charge frame 112 extends around the frame electrical conductor 118 between the two shaped charge receptacles 202. The bridge portion 220 extends between the two bearings 214, so one of the bearings 214 is captured between the bridge portion 220 and the shoulder 218, preventing axial motion of the bearing 214 between the bridge portion 220 and the shoulder 218. A snap ring 221, or other restraint, is disposed around the electrical conductor 118 at the second end 122 to restrain axial movement of another of the bearings 214 between the snap ring 221 and the bridge portion 220. The frame electrical conductor 118, the shaped charge frame 112, and the bearings 214 are shaped and sized to provide a small space between the bearings 214 and the frame electrical conductor 118 and the shaped charge frame 112 so the bearings 214 and the shaped charge frame 112 can rotate freely with respect to the frame electrical conductor 118. Rotation of the frame electrical conductor 118 is prevented by physical coupling with the other electrical connectors of the other members of the perforation tool 100.

Figure 2B:
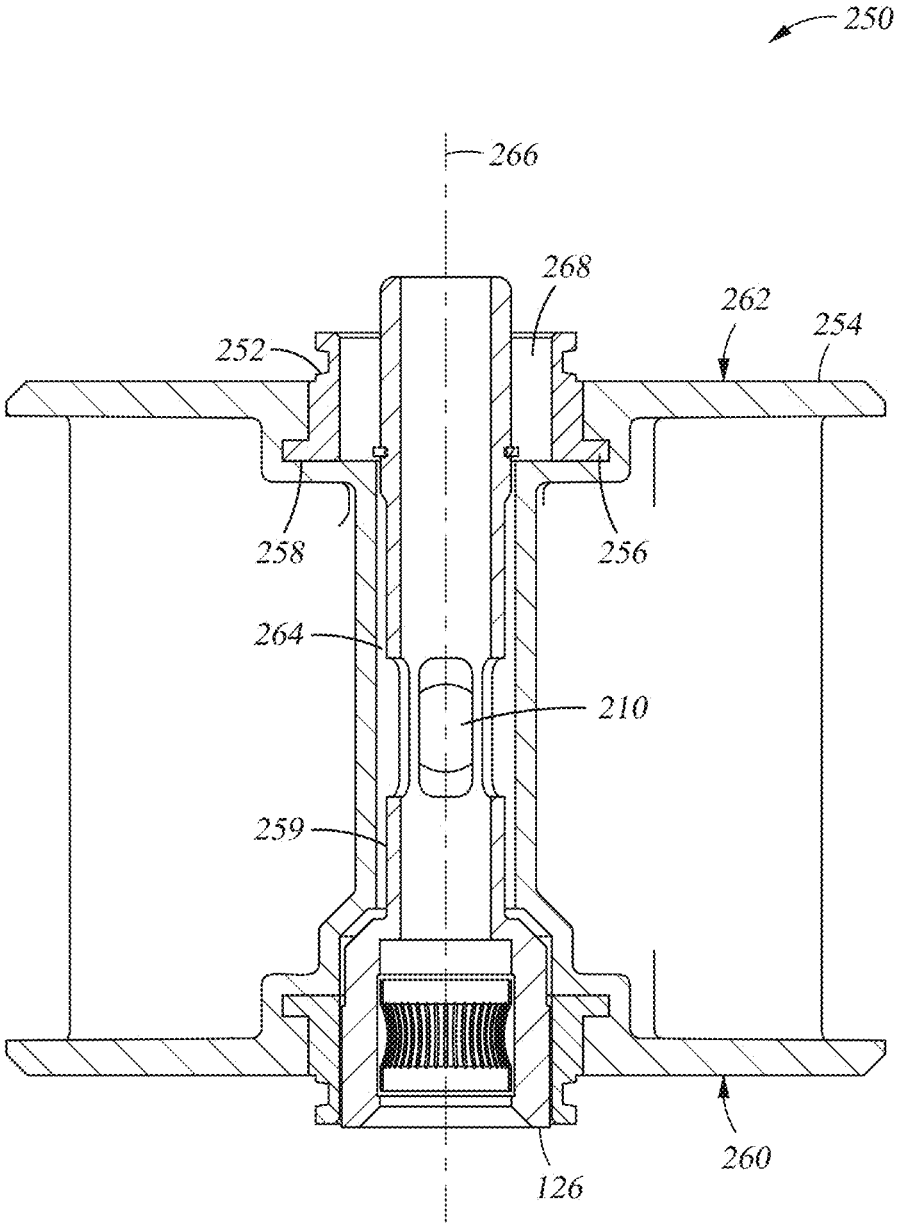
FIG. 2B is a cross-sectional view of a shaped charge frame assembly according to another embodiment.

FIG. 2B is a cross-sectional view of a shaped charge frame assembly 250 according to another embodiment. The shaped charge frame assembly 250 is similar to the shaped charge frame assembly 110 of FIG. 2A. The chief differences are in the type of bearings used, and in the configuration of the openings 212 of the electrical conductor. The shaped charge frame assembly 250 has two bearings 252, each of which is disposed within a recess of a shaped charge frame 254. The shaped charge frame 254 is similar to the shaped charge frame 112. The chief difference between the two shaped charge frames is that the shaped charge frame 254 is molded over the bearings 252, so the bearings 252 do not move with respect to the shaped charge frame 254. The bearings 252 are otherwise similar to the bearings 214. The bearings 252 are generally cylindrical, with an end flange 256 that facilitates retaining the bearing 252 within a recess 258 of the shaped charge frame 254.

Similar to the shaped charge frame 112, the shaped charge frame 254 has a first end 260 and a second end 262 opposite from the first end 260. The shaped charge frame assembly 250 includes a frame electrical conductor 259 disposed in a central conduit 264 that extends along a longitudinal axis 266 of the shaped charge frame 254. The frame electrical conductor 259 has the first connector 126 for seating in the conduit 264 at the first end 260. The bearing 252 at the first end 260 of the shaped charge frame 254 contacts the first connector 126 of the frame electrical conductor 259 to provide rotational support for the shaped charge frame 254 to rotate about the frame electrical conductor 259. The bearing 252 at the second end 262 is spaced apart from the frame electrical conductor 259 at the second end 262, such that the bearing 252 and the frame electrical conductor 259 define an annular gap 268 for receiving an electrical connector of another tool. In such cases, the bearing 252 at the second end 262 contacts the electrical connector of the connected tool to provide rotational support for the shaped charge frame 254.

The electrical conductor 259 of FIG. 2B has the openings 212 described above in connection with FIG. 2A, but in this case the openings 212 are aligned to provide a continuous open pathway from one shaped charge recess to the other on the opposite side of the shaped charge frame 254. In general, the openings 212 of the electrical conductors herein are large such that the exact configuration of the openings does not substantially impede ballistic continuity from the interior of the electrical conductors to the shaped charge recesses of the shaped charge frames.

Figure 2C:
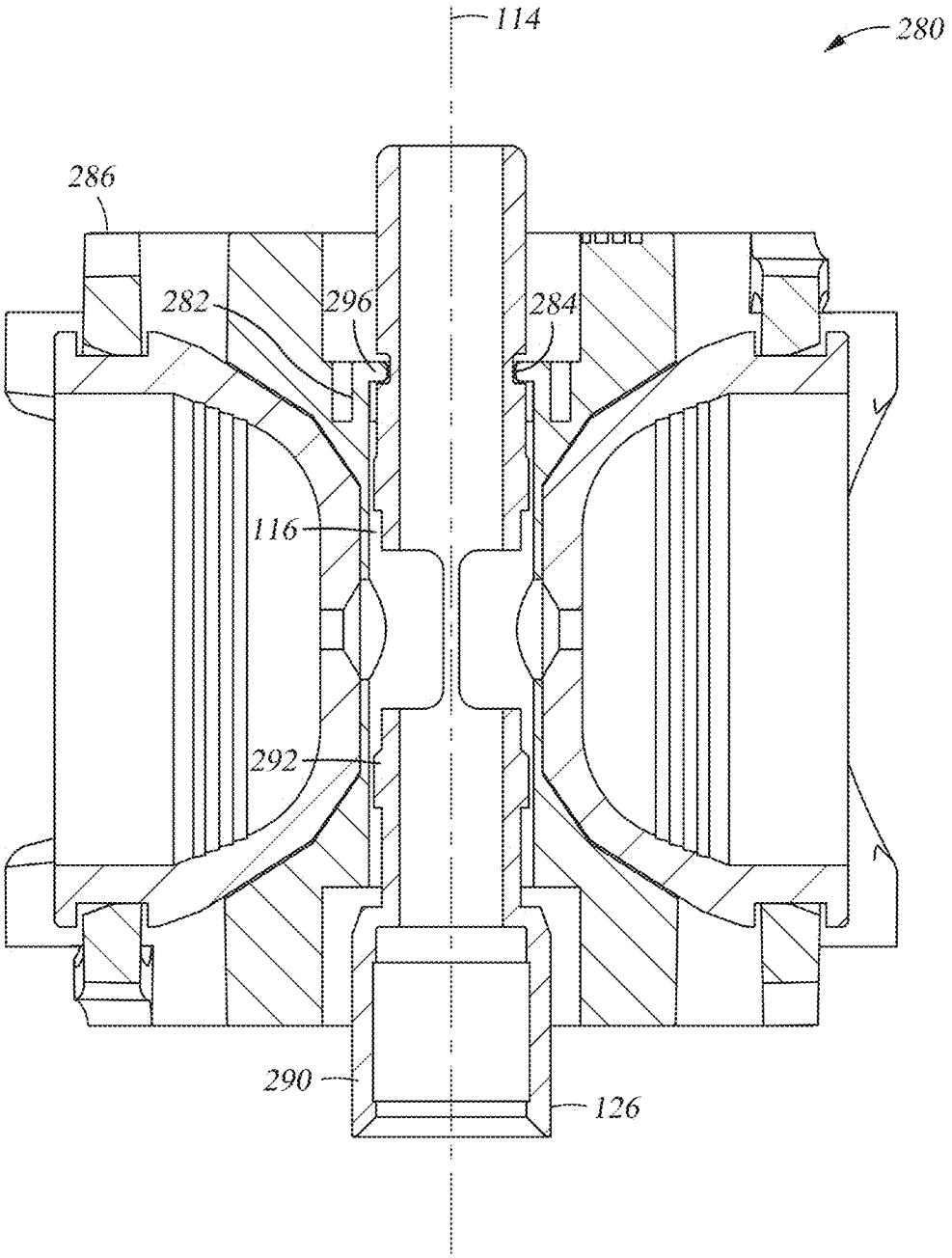
FIG. 2C is a cross-sectional view of a shaped charge frame assembly according to another embodiment.

FIG. 2C is a cross-sectional view of a shaped charge frame assembly 280 according to another embodiment. In FIG. 2C, no bearings are used. A bearingless shaped charge frame 286 is rotatable about an electrical conductor 290. The electrical conductor 290 has one or more external ridges 292 that reduce radial movement freedom for the frame 286 while allowing a small tolerance for rotational movement. The bearingless shaped charge frame 286 has a collar 282 along the central conduit 116 thereof with a shelf 296 that protrudes radially inward from the collar 282 to engage with a groove 284 formed in an outer wall of the electrical conductor 290. The collar 282 and shelf 296 engage with the groove 284 to prevent movement of the frame 286 in an axial direction with respect to the conductor 290.

In general, the shaped charge frames described herein are engaged with a tubular electrical conductor to rotate freely about the tubular electrical conductor. The engagement may be mediated by bearings, or as in FIG. 2C may be bearingless where the frame rotates freely about the tubular electrical conductor without the use of bearings. The engagement generally includes one or more restraints, such as the snap rings described in connection with FIGS. 2A and 2B, or the collar and shelf described in connection with FIG. 2C, to maintain the rotatable engagement of the shaped charge frame with the tubular electrical conductor. The tubular electrical conductor provides electrical continuity through the shaped charge frame and provides a location to place ballast members for ballistic continuity through the shaped charge frame. Weight members are disposed into recesses in the shaped charge frames to give a mass centroid displaced from the axis of rotation. Placement and mass of the weight members provides control of the position of the centroid so that the shaped charge frame self-orients to a desired orientation in a non-axial gravitational field.

Figure 3A:
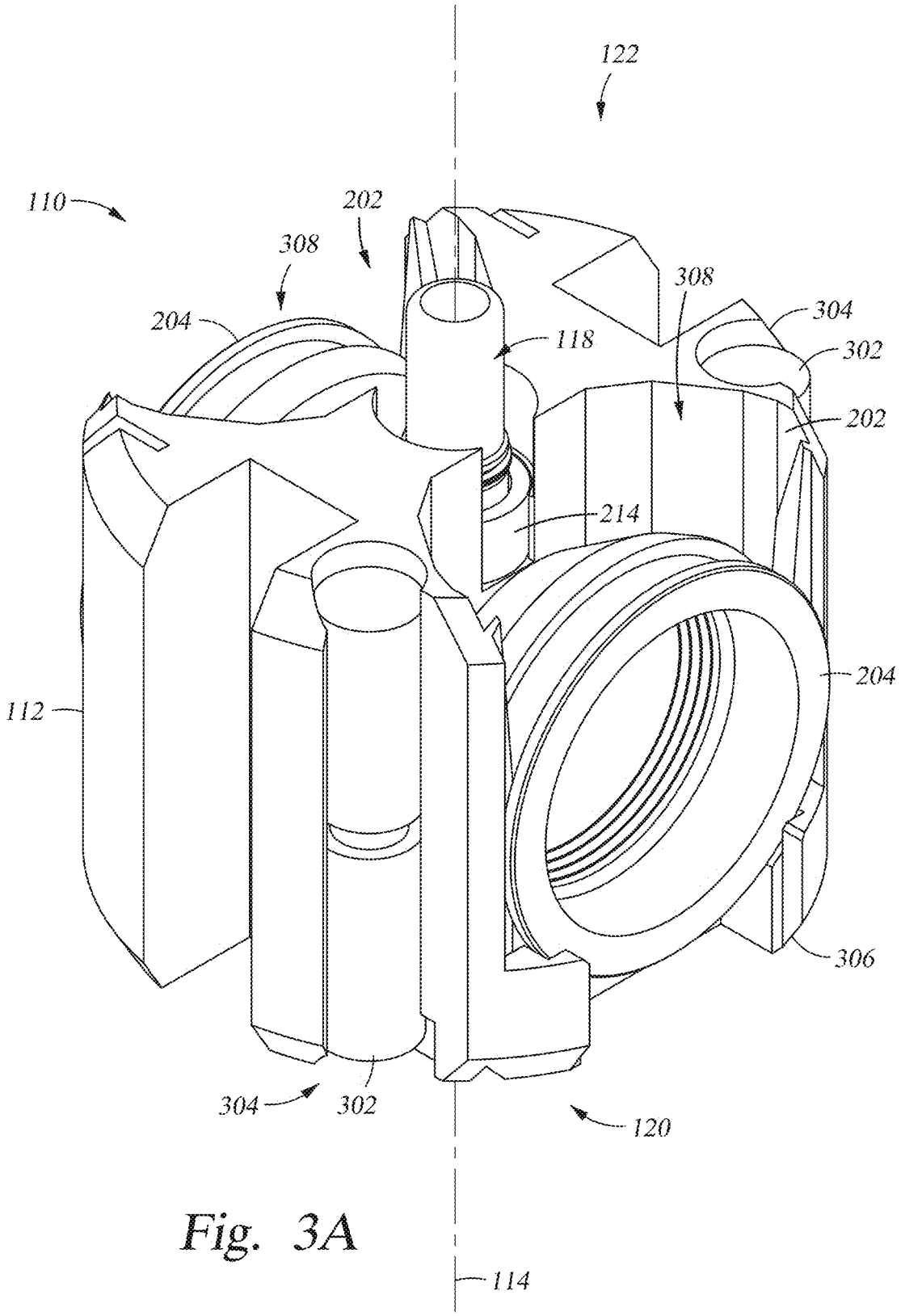
FIG. 3A is an isometric view of the shaped charge frame assembly of FIG. 1.

FIG. 3A is an isometric view of the shaped charge frame assembly 110. The shaped charge receptacles 202 are formed as channels in the bulk material of the shaped charge frame 112. The shaped charge frame assembly 110 uses one or more weight members 302 coupled to the shaped charge frame 112 to provide self-orientation of the rotatable shaped charge frame 112. In this case, two weight member 302 are shown. The weight members 302 are each disposed in a recess 304 of the shaped charge frame 112. Here, the recesses 304 extend from the first end 120 to the second end 122 of the shaped charge frame assembly 110. The one or more weight members 302 displace the center of mass radially away from the rotational axis of the shaped charge frame 112, which in this case substantially coincides with the longitudinal axis 114 of the shaped charge frame 112. In the event that, during a well operation, the perforation tool 100 encounters a gravitational field oriented non-parallel with the longitudinal axis 114, substantially the axis of rotation, of the shaped charge frame 112, the mass moment of the shaped charge frame 112, due to the weight member 302, causes the shaped charge frame 112 to rotate to an orientation defined by the mass distribution of the shaped charge frame 112 influenced by the position and mass of the weight member 302. In this way, any non-parallel gravitational field causes self-orientation of the shaped charge frame 112.

Here, two weight member 302 are used. The two weight member 302 are positioned such that a line from a longitudinal axis of one weight member 302 to a longitudinal axis of the other weight member 302 does not intersect the longitudinal axis 114 of the shaped charge frame 112. It should be noted that additional recesses can be provided in the shaped charge frame 112 for additional weight members 302. For example, instead of providing a continuous recess 304 that extends from one end of the shaped charge frame 112 to the other end, a series of discrete recesses can be provided in the bulk of the shaped charge frame 112 to allow insertion of multiple weight members 302 with positions selected to provide a desired orientation. The shaped charge frame 112 shown in FIG. 3A includes two channels having rectangular profiles formed in the bulk of the shaped charge frame 112 on diametrically opposite sides thereof and extending from the first end 120 to the second end 122. Instead of cutting such rectangular channels, additional recesses can be provided in this area for weight members 302.

It should also be noted that, as shown in FIG. 3A, the weight members 302 are cylindrical bars that extend substantially from the first end 120 to the second end 122. In other embodiments, partial weight members can be inserted into the recesses 304 having different weights to provide any desired mass moment. For example, one weight member half the size of the weight members 302 in FIG. 3A could be used along with a low density plug. Weight members can be provided to extend any fraction of the length of the recesses 304, and can be secured in the recesses 304 with plugs, to provide a continuous distribution of mass moments for the shaped charge frame 112. Such methods can provide a continuous distribution of orientations for the shaped charge frame 112, and can self-orient the shaped charge frame 112 to point the shaped charges in any desired direction under the influence of a non-parallel gravitational field.

The shaped charge receptacles 202 are formed as channels in the bulk of the shaped charge frame 112. Adjacent to the first end 120, each shaped charge receptacle 202 features a stop 306 that limits axial movement of the shaped charge 204. Adjacent to the second end 122, each shaped charge receptacle 202 features an opening 308 for inserting and extracting shaped charges 204. The shaped charges 204 slide laterally into the shaped charge receptacles 202 to the stop 306, and restraints engage with the shaped charges 204 to secure them in place.

Figure 3B:
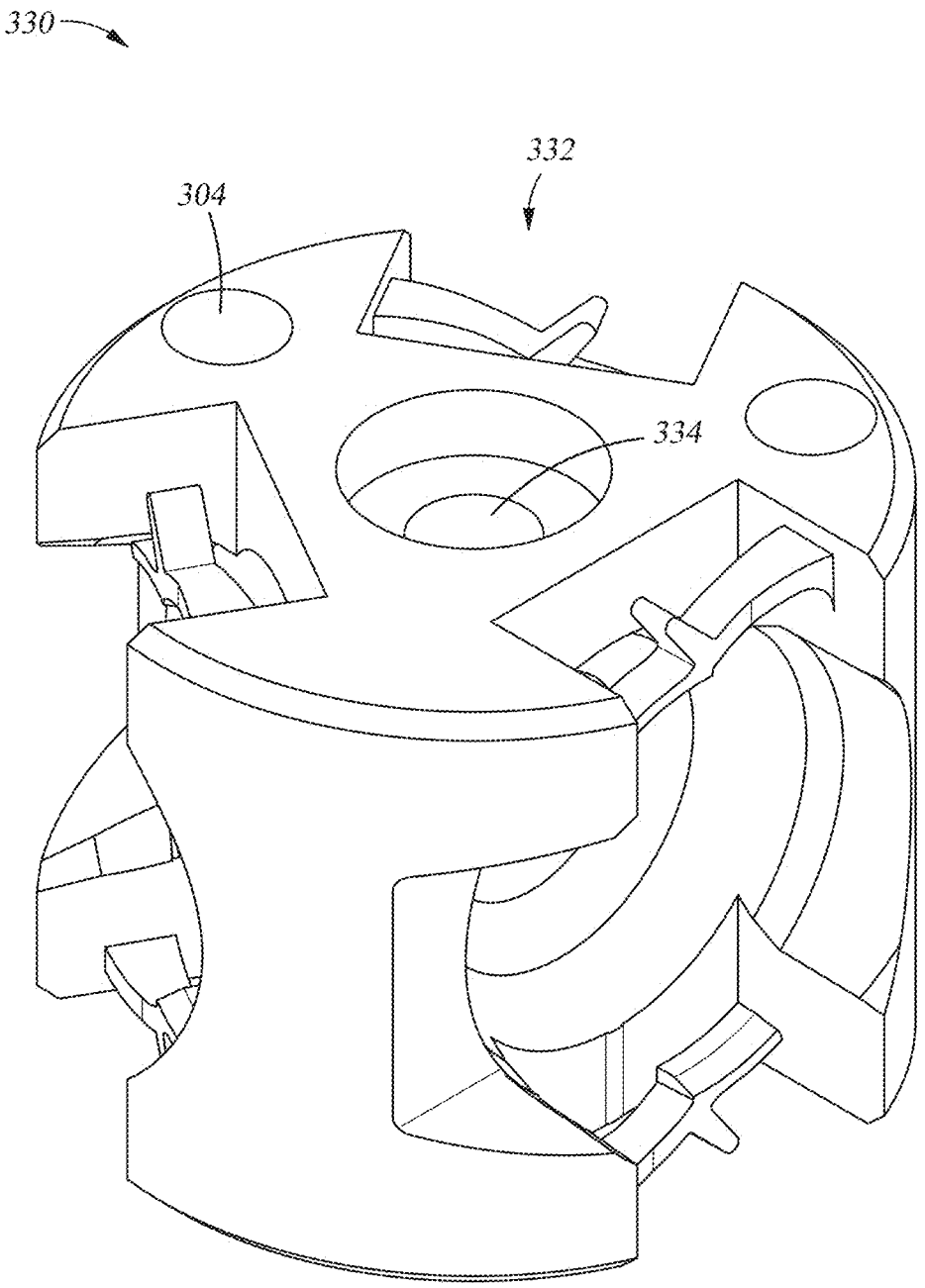
FIG. 3B is an isometric view of a shaped charge frame assembly according to another embodiment.

FIG. 3B is an isometric view of a shaped charge frame 330 according to another embodiment. The shaped charge frame 330 is similar to other shaped charge frames described herein. The shaped charge frame 330 receives a tubular electrical conductor in a central conduit 334 thereof, like the other shaped charge frames described herein. The chief difference in FIG. 3B is that the shaped charge frame 330 has three shaped charge recesses 332. Two weight member recesses 304, in this case, are located between adjacent shaped charge recesses 332 such that weight members disposed therein provide a mass centroid of the shaped charge frame 330 that is spaced apart from the axis of rotation through the central conduit 334. As in other embodiments herein, the weight member recesses 304 extend from end to end of the shaped charge frame 330 in a direction parallel to the longitudinal axis of the shaped charge frame 330. Any of the specific designs exemplified herein can be configured with three shaped charge recesses as shown in FIG. 3B.

Figure 3C:
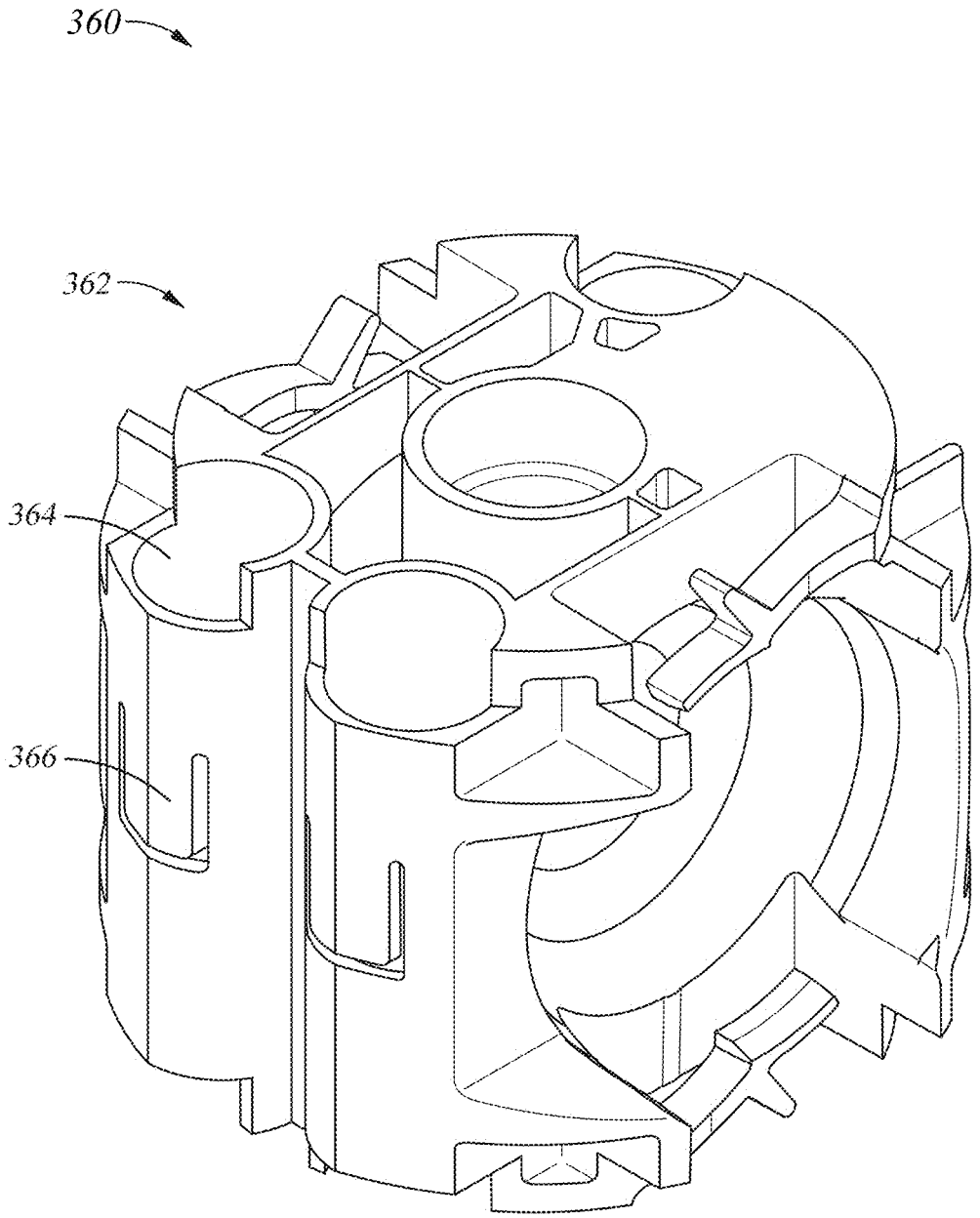
FIG. 3C is an isometric view of a shaped charge frame assembly according to another embodiment.

FIG. 3C is an isometric view of a shaped charge frame 360 according to yet another embodiment. The shaped charge frame 360 receives a tubular electrical conductor similar to the other embodiments herein. The shaped charge frame 360 features two weight member recesses 364 formed on one side of the frame 360 between the shaped charge receptacles 362 thereof (two, in this example), and one recess 364 formed on the other side of the frame 360. Each of the weight member recesses 364 has a tab 366 formed in an outer wall thereof for engaging with a feature, such as a groove, in an outer surface of a weight member disposed in the weight member recess 364. The tab 366 has an internal ridge that fits into the feature of the weight member inserted into the recess 364. The ridge engaged with the feature prevents axial movement of the weight member within the recess 364 to maintain position of the weight member within the recess 364. Such tabs can be implemented in any of the embodiments described herein.

With all the embodiments of shaped charge frames and assemblies described herein, weight members are used to move the mass centroid of the shaped charge frame away from the axis of rotation so that the shaped charge frame will self-orient in the presence of a non-axial gravitational field. Free rotation of the shaped charge frame allows the shaped charge frame to adopt a position with lowest gravitational potential as the orientation of the perforation tool with respect to the gravitational field changes. Although the positions of the weight member recesses generally are not changed, different weight members with different sizes (i.e. lengths) and densities can be disposed in the recesses to change where the mass centroid of the frame is located, thus changing the self-orientation angle of the frame. In the case of FIG. 3C, using different sizes and densities of weight members allows the frame 330 to be pre-oriented to assume any orientation in a 360° range.

Figure 4A:
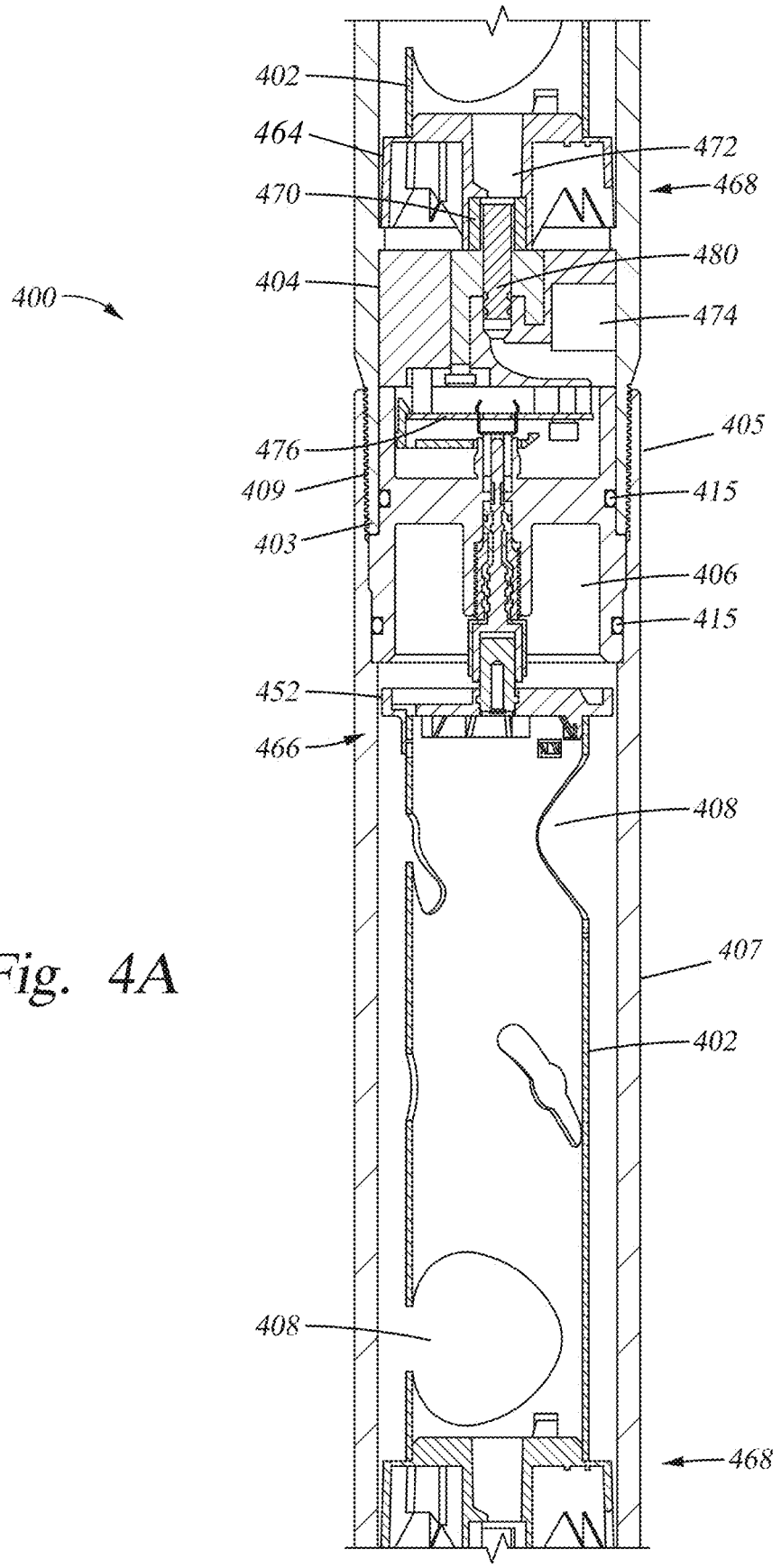
FIG. 4A is a cross-sectional view of a perforation apparatus according to one embodiment.

FIG. 4A is a cross-sectional view of a perforation apparatus 400 according to one embodiment. The perforation apparatus 400 has a loading tube 402 for holding explosive charges, an initiator module 404 that initiates discharge of the explosive charges, and a bulkhead member 406 that separates the explosive charges of the loading tube 402 from sensitive electronics in the initiator module 404. The loading tube 402 has a plurality of recesses 408 for receiving explosive charges and orienting the charges in a phased orientation. Thus, in this case, the perforation apparatus 400 activates a plurality of shaped charges using one initiator module 404 and one bulkhead member 406. Here, the recesses 408 are arranged in a spiral arrangement pointing in various directions from the central axis of the perforation apparatus 400 to provide phased discharge. In this case, each recess 408 points in a different direction than the other recesses 408, but some of the recesses 408 could point in the same direction. Here, each recess 408 points in a direction, and the direction of each recess 408 forms a constant angle with the direction of neighboring recesses 408. That is to say, in this case, the direction of each recess i and the direction of the neighboring recess i+1 forms an angle that is constant for all recesses i.

Figure 4B:
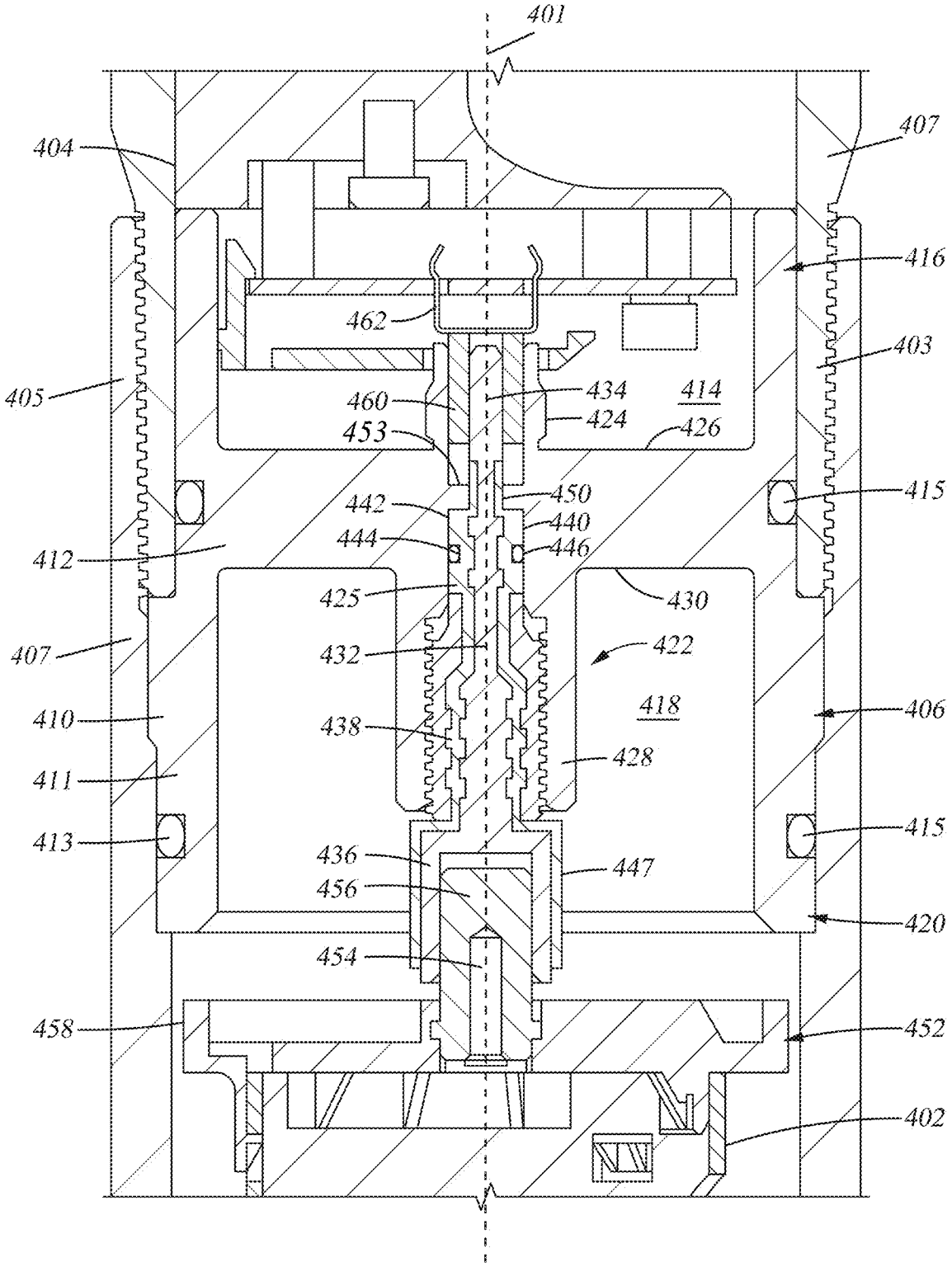
FIG. 4B is a detail view of the bulkhead member of FIG. 4A.

FIG. 4B is a detail view of the bulkhead member 406 of FIG. 4A. The bulkhead member 406 has a generally cylindrical body 410, or a shape conducive to housing in a desired casing. The body 410 of the bulkhead member 406 may be solid, or may be mostly hollow, as in this case. Here, the body 410 has an outer shell 411 with a central plate 412 transverse to a longitudinal axis of the body 410. The outer surface of the outer shell 411 has conveniently placed grooves 413 to receive seal members 415 for sealing against an outer casing. The central plate 412 provides structural support for components of the bulkhead member 406, while the hollow configuration of the body 410 reduces weight. The central plate 412 defines a first cavity 414, generally facing a first end 416 of the body 410, and a second cavity 418, generally facing a second end 420 of the body 410. The central plate 412 separates the first cavity 414 from the second cavity 418 such that when the bulkhead member 406 is assembled into a perforating tool, the first cavity 414 faces a first tool member and the second cavity 418 faces a second tool member. In the case of FIG. 4A, the first cavity 414 faces the initiator module 404 and the second cavity 418 faces the loading tube 402. The bulkhead member 406 may connect to the housing 402.

The central plate 412 supports a feedthrough 422, which provides a conduit for electrical conductivity from the first end 416 to the second end 420 of the bulkhead member 406. The feedthrough 422 has a central bore 425, oriented along the longitudinal axis of the bulkhead member 406, that extends through the central plate 412 from the first cavity 414 to the second cavity 418. A first protrusion 424 extends from a first side 426 of the central plate 412 into the first cavity 414, and a second protrusion 428 extends from a second side 430 of the central plate 412 into the second cavity 418. The central bore 425 extends along and within the first protrusion 424, through the central plate 412, and along and within the second protrusion 428 to provide a pathway through the central plate 412 from the first cavity 414 to the second cavity 418.

The bulkhead member 406, here, is non-symmetric. The bulkhead member 406 has a generally cylindrical shape with a central longitudinal axis 401 that generally resembles a cylindrical axis. In one aspect, a center of mass of the bulkhead member 406 is closer to the first end 416 of the bulkhead member 406 than to the second end 420 of the bulkhead member 406. In another aspect, the bulkhead member 406 has no plane of symmetry that intersects the central longitudinal axis 401. For example, the bulkhead member 406 has no transverse plane of symmetry.

An electrical conductor 432 is disposed in the central bore 425 to provide electrical conductivity from the first end 416 to the second end 420 of the bulkhead member 406. The electrical conductor 432 has a pin connection 434 at a first end thereof and a box connection 436 at a second end thereof opposite from the first end. When the electrical conductor 432 is installed in the bulkhead member 406, the pin connection 434 is disposed in the first protrusion 424 and the box connection 436 extends beyond the second protrusion 428. The electrical conductor 432 is a rod-like member that extends from the pin connection 434 at the first end to the box connection 436 at the other end The box connection 436 is a hollow cylindrical member with diameter larger than a diameter of the rest of the electrical conductor 432 so that the box connection 436 can receive an electrical connector of another tool into the hollow cylindrical box connection 436. In some embodiments, the box connection 436 may be described as a "female" electrical connection, while the pin connection 434 may be described as a "male" electrical connection. Here, the pin connection 434 is axially rigid with no axial movement capability such as spring-loading or extension/retraction.

An electrical insulator 438 is disposed within the central bore 425 around the electrical conductor 432 to prevent electrical connection between the electrical conductor 432 and the body 410. The body 410 is typically made of steel to provide pressure insulation between the loading tube 402, where the charges discharge, and the initiator module 404, where sensitive electronics are located to control operation of the tool. In some embodiments, where the body 410 can be made from a dense, hard, non-conducive material, such as hard plastic, the electrical insulator 438 might not be needed. The electrical insulator 438 has a seal portion 440 that inserts into a throat 442 of the central bore that extends into the central plate 412. The seal portion 440 has a groove 444 that accommodates a seal member 446 to provide a secure fit for the electrical conductor 432 within the central bore 425. The electrical insulator 438 extends from the seal portion 440 to an entry portion 447 that houses the box connection 436 of the electrical conductor 432. The entry portion 447 has a shape similar to the shape of the box connection 436, in this case a hollow cylindrical shape with an inner diameter approximately equal to an outer diameter of the box connection 436 so that an inner surface of the electrical insulator 438 contacts an outer surface of the box connection 436. The seal members 415 and 446 provide pressure seal against the hydrostatic pressure of the well environment, as well as pressure seal between adjacent tools.

The electrical conductor 432 extends beyond the seal portion 440 of the electrical insulator 438 through the central plate 412, where the central bore 425 defines an annular gap 450 around the electrical conductor 432. A wall 453 extends radially inward from an interior wall of the central bore 425 toward the electrical conductor 432 to define the gap 450. The electrical conductor 432 further extends into the first protrusion 424 to the pin connection 434. The electrical insulator 438 thus extends from the box connection 436 partway along the length of the electrical conductor 432 to the annular gap 450. Each of the electrical insulator 438 and the electrical conductor 432 extends beyond the second protrusion into the second cavity 418 and beyond the second end of the body 410 to provide an accessible electrical connection to accommodate another tool.

In FIG. 4B, the loading tube 402 has a connector 452 that can be inserted into the box connection 436 of the bulkhead member 406. The connector 452 has a metal pin 454 and a metal stub 456 over the metal pin 454, with an overmolded plastic body 458 that locates the metal pin 454 and metal stub 456 at the end of the loading tube 402. Inserting the metal stub 456 into the box connection 436 of the bulkhead member 406 establishes electrical connection between the bulkhead member 406 and the loading tube 402.

A plug connector 460 is disposed within the end of the first protrusion 424 around the pin connection 436 of the electrical conductor 432. The plug connector 460 provides electrical connection to a wire contact 462 of the initiator module 404. The plug connector 460 can be an RCA connector, or another convenient type of connector. The wire contact 462 connecting with the plug connector 460 electrically connects the bulkhead member 406 with the initiator module 404. In this way, electrical connection is established from the initiator module 404, through the bulkhead member 406, to the loading tube 402.

Returning to FIG. 4A, electrical conductivity is established along the loading tube 402 by connecting a wire (not shown) to the connector 452. The connector 452 is a first connector of the loading tube 402, located at a first end 466 thereof. The loading tube 402 has a second connector 464 located at a second end 468 thereof, opposite from the first end. The wire is connected from the first connector 452 to the second connector 464, traversing the length of the loading tube 402 according to any convenient path.

A second loading tube 402 is shown in FIG. 4A to illustrate connection of the loading tube 402, at the second end 468 thereof, to the initiator module 404. A band connector 470 is disposed in a central recess 472 of the second connector 464. The band connector 470 makes electrical contact with a housing 474 of the initiator module 404. The housing provides electrical connection to the wire contact 462 (FIG. 4B) of the initiator module 404 and a circuit board 476 disposed at an end of the initiator module 404 that connects to the bulkhead member 406, and oriented generally transverse to the longitudinal axis of the perforation tool 400. Alternately, in embodiments where the housing 474 is made of a non-conductive material, an electrical contact can be provided for connecting with the band connector 470, and an electrical conductor can be routed through the housing 474 for connection with the wire contact 462 and the circuit board 476.

The loading tube 402, initiator module 404, and bulkhead member 406 all fit within a housing 407. In FIG. 4A, the housings 407 of two adjacent and connected perforation assemblies are shown connected by a threaded connection 409, each end of each housing 407 having threads. Each housing 407 has a first end 403 and a second end 405, opposite from the first end 403, with each end 403 and 405 having threads. Here, the bulkhead member 406 is shown connecting with each end 403 and 405 of a housing 407. Referring again to FIG. 4B, the first end 416 of the bulkhead member 406 engages with a first end 403 of a first housing 407 while the second end 420 of the bulkhead member 406 engages with a second end 405 of a second housing 407, which is coupled to the first housing 407. In this case, the bulkhead member 406 connects with each housing using a friction fit, with a non-threaded connection, but a threaded connection can be used to connect the bulkhead member 406 with either the first end 403 or the second end 405 of a housing 407.

In operation a detonator 480 (FIG. 4A) is disposed in a recess of the initiator module 404. The detonator 480 extends into the central recess 472 of the second connector 464 of the loading tube 402. A booster (not shown) is also disposed in the central recess 472 of the second connector 464. Detonation cord is connected to the booster and routed along the loading tube 402 to the charges held therein. An electrical signal received at the circuit board 476, causes the circuit board to send an electrical signal that activates the detonator 480, which in turn discharges the booster. The ballistic discharge of the booster is transmitted by the detonation cord to the charges held in the loading tube 402.

While the foregoing is directed to embodiments of the present invention, other and further embodiments of the present disclosure may be devised without departing from the basic scope thereof, and the scope thereof is determined by the claims that follow.

We claim:

1. A shaped charge frame assembly, comprising:

a shaped charge frame having at least one shaped charge receptacle and a longitudinal axis that does not intersect the shaped charge receptacle;

an electrical conductor disposed through the shaped charge frame along the longitudinal axis of the shaped charge frame, wherein the electrical conductor has a plurality of lateral openings; and at least one cylindrical bearing disposed around the electrical conductor, wherein the at least one bearing is freely rotatable between the electrical conductor and the shaped charge frame, wherein the at least one shaped charge receptacle has an opening in registration with at least one lateral opening of the plurality of lateral openings of the electrical conductor providing a fluid pathway from an interior of the electrical conductor to the at least one shaped charge receptacle.

2. The shaped charge frame assembly of claim 1, wherein the at least one cylindrical bearing comprises at least two cylindrical bearings, and wherein the at least two cylindrical bearings are freely rotatable between the electrical conductor and the shaped charge frame.

3. The shaped charge frame assembly of claim 1, wherein the electrical conductor protrudes from one or more ends of the shaped charge frame.

4. The shaped charge frame assembly of claim 1, further comprising at least one weight member disposed in a recess of the shaped charge frame.

5. The shaped charge frame assembly of claim 1, wherein the electrical conductor is not in contact with the shaped charge frame.

6. The shaped charge frame assembly of claim 1, wherein the electrical conductor is hollow.

7. A perforation tool, comprising:

the shaped charge frame assembly of claim 1; and a bulkhead assembly.

8. The perforation tool of claim 7, wherein the bulkhead assembly comprises:

a bulkhead member having a longitudinal axis and a conduit along the longitudinal axis of the bulkhead member.

9. The perforation tool of claim 8, wherein the bulkhead assembly comprises:

a bulkhead electrical conductor disposed in the conduit and coupled to the electrical conductor.

10. The perforation tool of claim 9, wherein the bulkhead electrical conductor has a pin connection that connects with a box connection of an initiator module.

11. The perforation tool of claim 9, wherein the bulkhead electrical conductor is non-symmetric.

12. The perforation tool of claim 7, further comprising an initiator assembly.

13. The perforation tool of claim 12, wherein the electrical conductor is configured to provide electrical connectivity with the initiator assembly of the perforation tool.

14. The perforation tool of claim 12, wherein the initiator assembly comprises:

an initiator housing having a longitudinal axis and a conduit along the longitudinal axis of the initiator housing.

15. The perforation tool of claim 14, wherein the initiator assembly comprises:

an electrical conductor disposed in the conduit of the initiator housing and coupled to the electrical conductor of the shaped charge assembly.

16. The perforation tool of claim 7, wherein the electrical conductor is configured to provide electrical connectivity with the bulkhead assembly.

* * * * *